US006588340B2

(12) United States Patent
Friedman

(10) Patent No.: US 6,588,340 B2
(45) Date of Patent: Jul. 8, 2003

(54) METHOD FOR MAKING A PRINTING PLATE

(75) Inventor: Patrick R. Friedman, Bridgewater, NJ (US)

(73) Assignee: Kodak Polychrome Graphics LLC, Norwalk, CT (US)

( * ) Notice: Subject to any disclaimer, the term of this patent is extended or adjusted under 35 U.S.C. 154(b) by 34 days.

(21) Appl. No.: 09/783,776

(22) Filed: Feb. 15, 2001

(65) Prior Publication Data

US 2002/0108519 A1 Aug. 15, 2002

(51) Int. Cl.[7] ..... B41C 1/10
(52) U.S. Cl. ..... 101/467; 219/121.69; 219/121.84
(58) Field of Search ..... 101/457, 459, 101/460, 462, 463.1, 465, 466, 467; 430/302, 303, 945; 219/121.69, 121.84; 83/22, 53, 177; 433/29, 215; 606/10, 13, 16

(56) References Cited

U.S. PATENT DOCUMENTS

| | | | | | |
|---|---|---|---|---|---|
| 4,689,467 | A | * | 8/1987 | Inoue | 219/121.84 |
| 5,020,995 | A | | 6/1991 | Levy | 433/215 |
| 5,188,032 | A | * | 2/1993 | Lewis et al. | 101/453 |
| 5,194,005 | A | | 3/1993 | Levy | 433/215 |
| 5,267,856 | A | * | 12/1993 | Wolbarsht et al. | 433/29 |
| 5,339,737 | A | | 8/1994 | Lewis et al. | 101/454 |
| 5,356,081 | A | * | 10/1994 | Sellar | 219/121.62 |
| 5,483,883 | A | * | 1/1996 | Hayama et al. | 101/128.4 |
| 5,605,780 | A | * | 2/1997 | Burberry et al. | 430/944 |
| 5,741,247 | A | | 4/1998 | Rizoiu et al. | 606/10 |
| 5,762,501 | A | | 6/1998 | Levy | 433/215 |
| 5,785,521 | A | | 7/1998 | Rizoiu et al. | 433/29 |
| 5,829,353 | A | * | 11/1998 | Ellis | 101/460 |
| 5,908,705 | A | | 6/1999 | Nguyen et al. | 428/461 |
| 6,145,565 | A | * | 11/2000 | Fromson et al. | 101/457 |

* cited by examiner

*Primary Examiner*—Stephen R. Funk
(74) *Attorney, Agent, or Firm*—Faegre & Benson LLP

(57) ABSTRACT

A method of producing a printing plate comprises:

(a) providing a printing plate precursor comprising a topmost etchable first layer and a second layer located below the first layer, wherein the first and second layers have different affinities for at least one printing liquid;

(b) imagewise providing atomized fluid particles in an interaction zone located above the surface of the first layer; and (c) imagewise directing laser energy into the interaction zone, wherein the laser energy has a wavelength which is substantially absorbed by the atomized fluid particles in the interaction zone, and the absorption of the laser energy causes the atomized fluid particles to imagewise impart kinetic energy to and etch the first layer. Lithographic and flexographic printing plates may be prepared according to this method, including waterless plates, negative-and positive-working plates, and processless plates.

10 Claims, 10 Drawing Sheets

(6 of 10 Drawing Sheet(s) Filed in Color)

100X

Paper Clip
Rapid Surface Etching
Figure 14A
Figure 14B
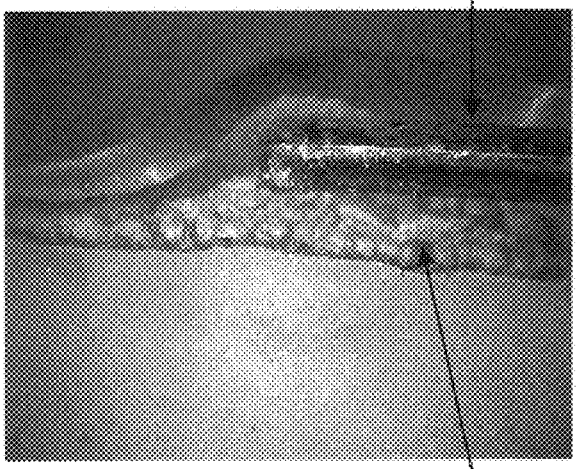
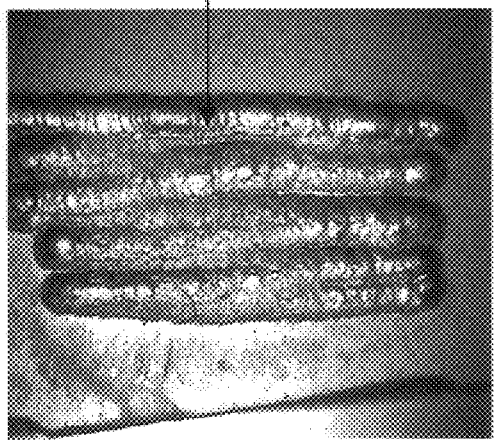
Figure 14C
Deep Cut Grooves
Figure 14D
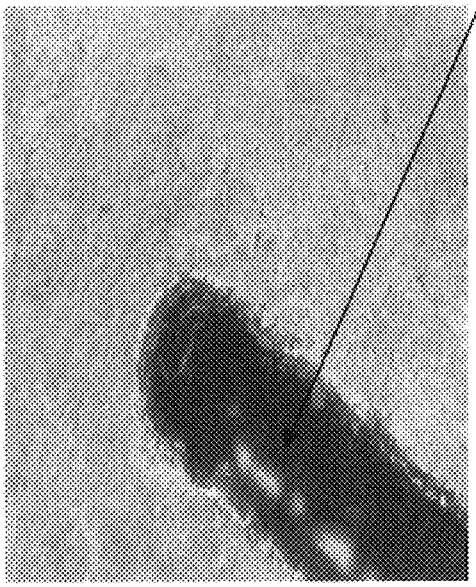
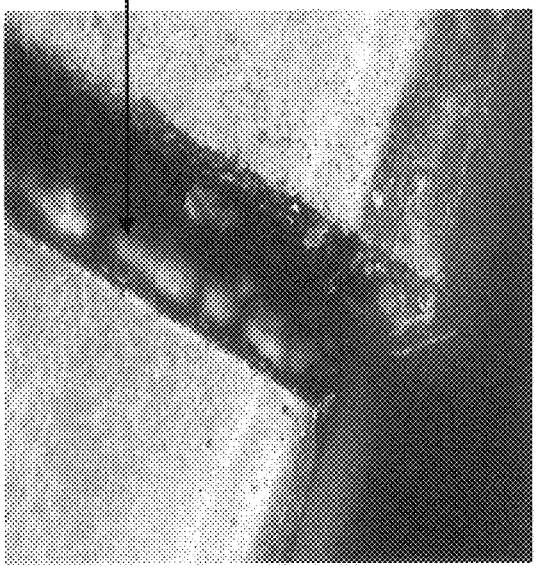

METHOD FOR MAKING A PRINTING PLATE

BACKGROUND OF THE INVENTION

1. Field of the Invention

This invention is directed to a method for making a printing plate and to a printing plate made according to such a method. More particularly, this invention is directed to a process in which a printing plate precursor is provided which comprises a topmost etchable first layer and a second layer located below the first layer, wherein the first and second layers have different affinities for at least one printing liquid. The first layer is imagewise etched by kinetic energy obtained from the rapid vaporization of liquid droplets. The vaporization is achieved by impinging the liquid droplets with laser energy in close proximity to the topmost first layer.

2. Background Information

The art of lithographic printing is based upon the immiscibility of oil and water, wherein the oily material or ink is preferentially retained by the image area and the water or fountain solution is preferentially retained by the non-image area. When a suitably prepared surface is moistened with water and an ink is then applied, the background or non-image area retains the water and repels the ink while the image area accepts the ink and repels the water. The ink on the image area is then transferred to the surface of a material upon which the image is to be reproduced, such as paper, cloth and the like. Commonly the ink is transferred to an intermediate material called the blanket which in turn transfers the ink to the surface of the material upon which the image is to be reproduced.

A very widely used type of lithographic printing plate has a light-sensitive coating applied to an aluminum base support. The coating may respond to light by having the portion which is exposed become soluble so that it is removed in the developing process. Such a plate is referred to as positive-working. Conversely, when that portion of the coating which is exposed becomes hardened, the plate is referred to as negative-working. In both instances the image area remaining is ink-receptive or oleophilic and the non-image area or background is water-receptive or hydrophilic. The differentiation between image and non-image areas is made in the exposure process where a film is applied to the plate with a vacuum to insure good contact. The plate is then exposed to a light source, a portion of which is composed of UV radiation. In the instance where a positive plate is used, the area on the film that corresponds to the image on the plate is opaque so that no light will strike the plate, whereas the area on the film that corresponds to the non-image area is clear and permits the transmission of light to the coating which then becomes more soluble and is removed. In the case of a negative plate the converse is true. The area on the film corresponding to the image area is clear while the non-image area is opaque. The coating under the clear area of film is hardened by the action of light while the area not struck by light is removed. The light-hardened surface of a negative plate is therefore oleophilic and will accept ink while the non-image area which has had the coating removed through the action of a developer is desensitized and is therefore hydrophilic.

Lithographic plates may be divided into classes based upon their affinity for printing ink. Those which require dampening water which is fed to the non-image areas of the plate, forms a water film and acts as an ink-repellant layer; this is the so-called fount solution. Those which require no fount solution are called driographs or water-less lithographic plates. Most lithographic plates at present in use are of the first type and require a fount-solution during printing. However, lithographic plates of this type suffer from a number of disadvantages. Some of these are:

- Adjustment of the proper ink-water balance during press operation is difficult and requires great experience. If the correct ink-water balance is not achieved scumming is occasioned when the printed ink image extends into the non-image areas thereby ruining the printed image.
- Adjustment of the ink-water balance at start-up or re-start up is particularly difficult and can not be stabilized until a large number of sheets have been printed, thus incurring waste.
- The ink tends to become emulsified which leads to poor adherence of the ink onto the plate which causes problems in color reproduction and in dot reproduction.
- The printing press has to be provided with a dampening system, thus increasing its size and complexity. These dampening solutions contain volatile organic compounds.
- The plate care chemistry and fount solutions require careful control and selection. In addition, plate cleaners contain significant levels of solvent which is not desirable.

However, with water-less plates in which the ink-releasing layer is, for example, a cured silicone layer there is no scumming and clearer images can be produced. Very often water-less plates comprise a base material, for example aluminum plate, on which a photosensitive layer is coated, on this photosensitive layer there is coated a silicone layer. After imagewise exposure and development in which selected areas of the photosensitive composition are altered, the overlying silicone layer is removed and the plate is inked up. The ink adheres only to those areas of the plate not covered by the silicone remaining after development. Thus the plate can be printed without the need to use a fount solution. In practice it is difficult and costly to formulate and manufacture the silicone layer composition with sufficient adhesion to the photosensitive composition in these multi-layer assemblies. Thus the only commercially available water-less lithographic plates are expensive and of complex design.

There exists in patent literature water-less lithographic plate designs which do not exhibit these disadvantages. These inventions disclose photosensitive water-less lithographic plate precursors comprising a support with an oleophilic surface and a single layer, photosensitive, ink-releasing composition such that imagewise exposure causes changes in developer solubility of the composition where development produces an ink accepting image pattern on the uncovered support surface and an ink-releasing non-image area corresponding to unremoved composition.

There are numerous known methods for creating image and non-image areas. Some methods rely on the differential solubility of exposed and non-exposed areas in a developer; others use incident radiation to break covalent bonds of radiation sensitive formulations or to ablate a layer of material.

Lithography and offset printing methods have long been combined in a compatible marriage of great convenience for the printing industry for economical, high speed, high quality image duplicating in small runs and large. Known art available to the industry for image transfer to a lithographic plate is voluminous but dominated by the photographic process wherein a hydrophilic plate is treated with a photosensitive coating, exposed via a film image and developed to produce a printable, oleophilic image on the plate.

While preparing lithographic plates by photographic image transfer is relatively efficient and efficacious, it is a multi-step, indirect process of constrained flexibility. Typically, a photographically presensitized (PS) plate is prepared from a hydrophilic surface-treated aluminum. A positive or negative film image of an original hard copy is prepared and the PS plate exposed to the film image, developed, washed and made ready for print operations. Any desired changes in the film image must be made by first changing the original hard copy and repeating the photographic process; hence, the constrained flexibility. As sophisticated and useful as it is to prepare plates by photographic image transfer, the need for a lithographic plate fabricating process that obviates the above problems associated with the photographic process has long been recognized.

Clearly, it would be highly beneficial to the printing industry to directly produce a quality printable image on a plate without proceeding through a multi-step photographic process. It would also be highly efficacious if a process were developed whereby changes could be made in an original image in some predetermined manner without incurring the need to correct hard copy and repeat the photography, particularly if those changes could be made "on line." Consistent with these goals, artisans in the field of lithographic plate production have recently come to direct their efforts toward the development of a means to integrate digitally controlled image-making technology, i.e., the ubiquitous personal computer, with a means to directly convey the digital image onto a lithographic plate that will be usable for large production runs (100,000 or more copies).

Image forming by digital computer aided design of graphical material or text is well known. Electronically derived images of words or graphics presented on the CRT of a digital computer system can be edited and converted to final hard copy by direct printing with impact printers, laser printers or ink jet printers. This manner of printing or producing hard copy is extremely flexible and useful when print runs of no more than a few thousand are required but the print process is not feasible for large runs measured in the tens or hundreds of thousands of pieces. For large runs, printing by lithographic plate is still the preferred process with such plates prepared by the process of photographic image transfer.

As disclosed, for example, at col. 2, line 21 to col. 3, line 10 of co-assigned U.S. Pat. No. 5,908,705 and the references cited therein, and U.S. Pat. No. 5,339,737 and the references cited therein, lasers and their amenability to digital control have stimulated a substantial effort in the development of laser-based imaging systems. Early examples utilized lasers to etch away material from a plate blank to form an intaglio or letterpress pattern. This approach was later extended to production of lithographic plates, e.g., by removal of a hydrophilic surface to reveal oleophilic underlayers. These systems generally require high-power lasers which are expensive and slow.

A second approach to laser imaging involves the use of thermal-transfer materials. With these systems, a polymer sheet transparent to the radiation emitted by the laser is coated with a transferable material. During operation the transfer side of this construction is brought into contact with an acceptor sheet, and the transfer material is selectively irradiated through the transparent layer. Irradiation causes the transfer material to adhere preferentially to the acceptor sheet. The transfer and acceptor materials exhibit different affinities for fountain solution and/or ink, so that removal of the transparent layer together with non-irradiated transfer material leaves a suitably imaged, finished plate. Typically, the transfer material is oleophilic and the acceptor material hydrophilic. Plates produced with transfer-type systems tend to exhibit short useful lifetimes due to the limited amount of material that can effectively be transferred. In addition, because the transfer process involves melting and resolidification of material, image quality tends to be visibly poorer than that obtainable with other methods.

Lasers have also be used to expose a photosensitive blank for traditional chemical processing. In an alternative to this approach, a laser has been employed to selectively remove, in an imagewise pattern, an opaque coating that overlies a photosensitive plate blank. The plate is then exposed to a source of radiation with the unremoved material acting as a mask that prevents radiation from reaching underlying portions of the plate. Either of these imaging techniques requires the cumbersome chemical processing associated with traditional, non-digital platemaking.

Lithographic printing plates suitable for digitally controlled imaging by means of laser devices have also been disclosed in the prior art. Here, laser output ablates one or more plate layers, resulting in an imagewise pattern of features on the plate. Laser output passes through at least one discreet layer and imagewise ablates one or more underlying layer. The image features produced exhibit an affinity for ink or an ink-abhesive fluid that differs from that of unexposed areas. The ablatable material used to describe the image is deposited as an intractable, infusible, IR absorptive conductive polymer under an IR transparent polymer film. As a consequence, the process of preparing the plate is complicated and the image produced by the ablated polymer on the plate does not yield sharp and distinct printed copy.

Flexographic printing plates are also well known to those skilled in the art. Flexographic printing typically involves one of three different types of image carriers:

- Rubber plates, in which a negative of the desired image is placed on a metal alloy coated with a light sensitive acid resist. Upon exposure, the exposed resist areas harden and become insoluble, but the unexposed areas remain soluble and are washed away. An etchant is applied to the surface, thereby engraving the areas unprotected by the hardened resist, and resulting in a metallic relief plate. A mold is then made of the relief plate, and a rubber sheet is pressed into the mold to obtain a rubber relief plate.
- Photopolymer plates, in which a photographic negative of the desired image is placed on a photopolymeric material which is then exposed to UV radiation, thereby hardening the photopolymer in the exposed areas. The unhardened areas of the photopolymer are removed via washing, leaving the image areas in relief.
- Design rolls, in which a layer of vulcanized rubber is applied to the surface of a plate cylinder, and the desired image is engraved thereupon using a high energy laser, which atomizes rubber in the non-image areas, thus leaving the image areas in relief. The height of the image above the floor of the cylinder can be varied in the engraving process, depending upon the level of relief desired.

The use of laser radiation to cut or ablate materials in medical and dental applications is well known. For example, U.S. Pat. Nos. 5,020,995; 5,194,005; and 5,762,501 disclose the use of laser radiation having a selected wavelength to cut, by vaporization, dentin, tooth enamel, gum tissue, vascularized tissue, bone, metal fillings and the like. In addition, U.S. Pat. Nos. 5,741,247 and 5,785,521 disclose the use of a laser in medical and dental applications for accurate cutting of hard and soft tissue and other materials. More particularly U.S. Pat. No. 5,741,247 discloses an apparatus in which laser energy is used to vaporize or explode atomized fluid particles in the vicinity of the target area. The explosive forces released from the vaporized fluid particles impart mechanical cutting forces onto the target.

It is one object of this invention to provide a method of preparing a printing plate, in which a printing plate precursor is directly imaged by imagewise etching the precursor using kinetic energy derived from the rapid vaporization of liquid droplets which have absorbed laser energy. It is another object of this invention to provide a printing plate prepared using the method of this invention. This invention advantageously permits the desired image to be etched directly upon the printing plate precursor, thereby avoiding the need for films, masks, wet chemistry or exposure techniques. It is one feature of this invention that the imaging may be accomplished via a digital system which controls the placement of the laser radiation and targeting of the kinetic energy to selected portions of the etchable material portion of the precursor. It is another feature of this invention that no pre-exposure, post-exposure, or post-imaging chemical treatments are required to "develop" the desired image. It is another advantage of this invention that it is "white light safe," i.e., since the method does not depend upon a photochemical change to occur in the precursor to obtain the desired image, the need of protecting the precursor from "white" light (e.g. sunlight) is obviated. It is another feature of this invention that the thermal stability of the resulting printing plate is not compromised due to direct response of the imageable portion of the precursor to the laser. This invention also advantageously results in a low amount of residue material (typically dust) remaining on the plate surface after ablative imaging, thereby avoiding possible damage to the imaging and printing equipment due to the presence of such dust. It is another feature of this invention that the laser imaging and plate system described herein is less expensive than conventional laser thermal imaging and plate systems. Other objects, features and advantages of this invention will be readily apparent to those skilled in the art.

SUMMARY OF THE INVENTION

This invention is directed to a method of producing a printing plate comprising:

(a) providing a printing plate precursor comprising a topmost etchable first layer and a second layer located below the first layer, wherein the first and second layers have different affinities for at least one printing liquid;

(b) imagewise providing atomized fluid particles in an interactive zone located above the top surface of the first layer; and (c) directing laser energy into the interactive zone, wherein the laser energy has a wavelength which is substantially absorbed by the atomized fluid particles in the interaction zone, and the absorption of the laser energy causes the atomized fluid particles to imagewise impart kinetic energy to and etch the first layer.

This invention is also directed to printing plates prepared by the above-described method. Printing plates which may be prepared in accordance with this invention include waterless plates, positive-and negative-working plates, and flexographic plates.

BRIEF DESCRIPTION OF THE DRAWINGS

FIGS. 14A–14D are photographs of the etched plate described in Example 6.

DETAILED DESCRIPTION OF THE INVENTION

The method and printing plate of this invention will become apparent from the following detailed description of various preferred embodiments of the invention together with specific references to the accompanying figures and examples.

Figure 1:
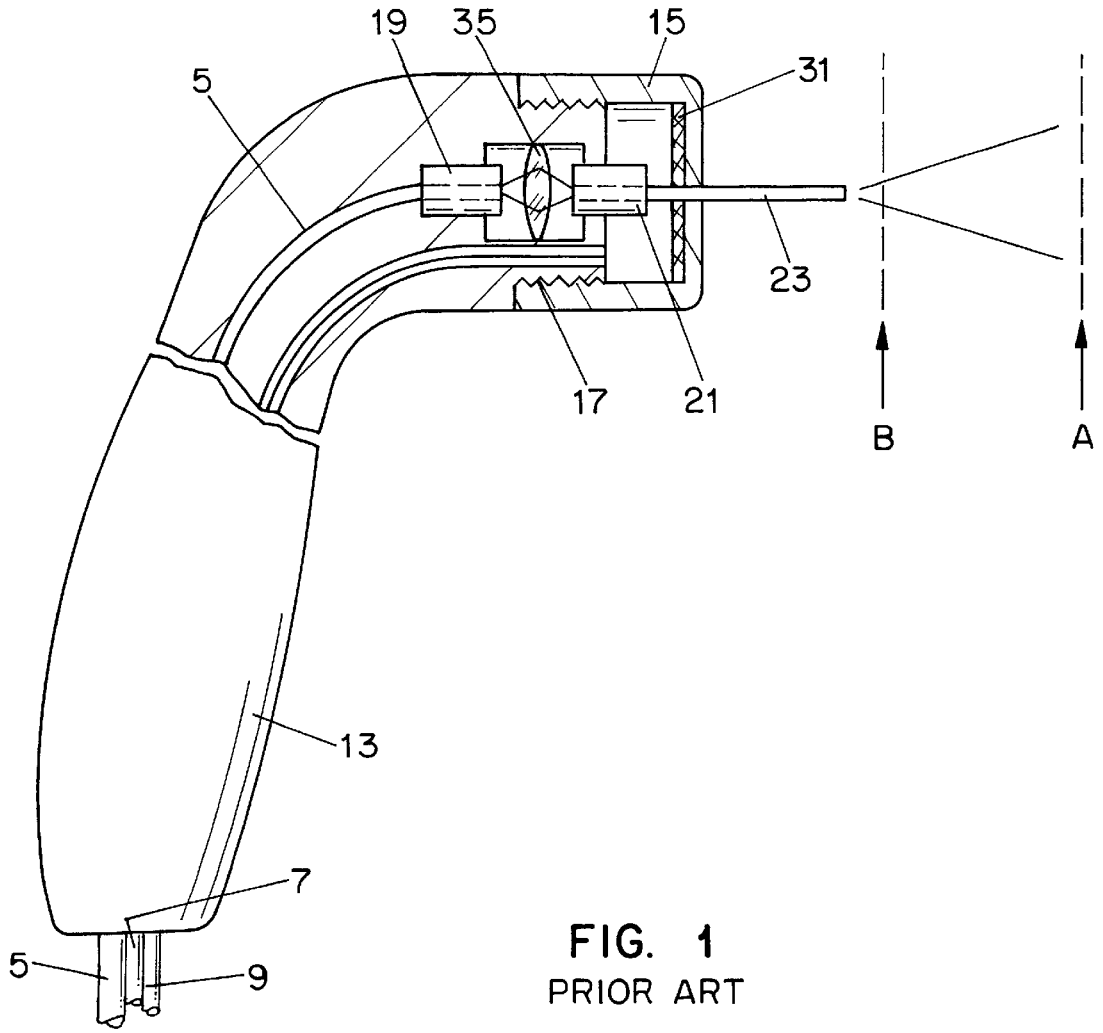
FIG. 1 PRIOR ART
FIG. 1 (corresponding to FIG. 2 in U.S. Pat. No. 5,741, 247) is a prior art laser apparatus which may be used in the method of this invention.

FIG. 1 shows a prior art laser apparatus which may be used in the method of the present invention. FIG. 1 and its description herein corresponds to FIG. 2 and the accompanying description thereof in U.S. Pat. No. 5,741,247, which is incorporated herein by reference. The laser apparatus 13 contains a focusing optic 35 placed between two metal cylindrical objects 19 and 21. A fiber guide tube 5, water line 7 and air line 9 are fed into the apparatus 13. A cap 15 fits onto the apparatus 13 and is secured via threads 17. The focusing optic 35 prevents undesired dissipation of laser energy from the fiber guide tube 5. Specifically, energy from the fiber guide tube 5 dissipates slightly before being focused by the focusing optic 35. The focusing optic 35 focuses energy from the fiber guide tube 5 into the fiber guide tube 23. The efficient transfer of laser energy from the fiber guide tube 5 to the fiber guide tube 23 vitiates any need for a conventional air knife cooling system (such as depicted in FIG. 1 of U.S. Pat. No. 5,741,247 and discussed therein), since little laser energy is dissipated. The first fiber guide tube 5 comprises a trunk fiberoptic, which comprises one of calcium fluoride (CaF), calcium oxide ($CaO_2$), zirconium oxide ($ZrO_2$), zirconium fluoride (ZrF), sapphire, hollow waveguide, liquid core, TeX glass, quartz silica, germanium sulfide, arsenic sulfide, and germanium oxide ($GeO_2$). Although other prior art optical cutters focus laser energy on a target surface at an area A, for example, the laser apparatus employed in the present invention must focus laser energy into an interaction zone B, so that the laser energy may be absorbed by the atomized fluid particles located therein, and the laser energy is not directly absorbed by the etchable layer portion of the precursor.

Figure 2:
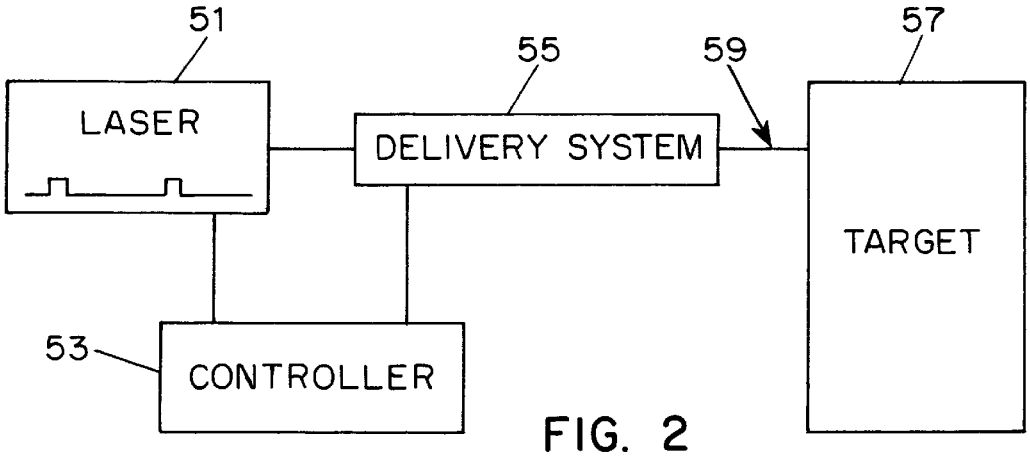
FIG. 2 PRIOR ART
FIG. 2 is a schematic block diagram illustrating the use of the prior art laser apparatus of FIG. 1 in the method of this invention.

FIG. 2 is a block diagram illustrating a laser apparatus which may be used in the method of this invention. FIG. 2 and its description herein correspond to FIG. 3 in U.S. Pat. No. 5,741,247 and its accompanying description therein. A laser 51 is coupled to both a controller 53 and a delivery system 55. The delivery system 55 imparts mechanical forces or kinetic energy onto the target surface 57. As presently embodied, the delivery system 55 comprises a fiberoptic guide for routing the laser 51 into an interaction zone 59, located above the target surface 57 (which in the present invention is the etchable layer portion of the precursor). The delivery system 55 further comprises an atomizer for delivering user-specified combinations of atomized fluid particles into the interaction zone 59. The controller 53 controls various operating parameters of the laser 51, and further controls specific characteristics of the user-specified combination of atomized fluid particles output from the delivery system 55.

Figure 3:
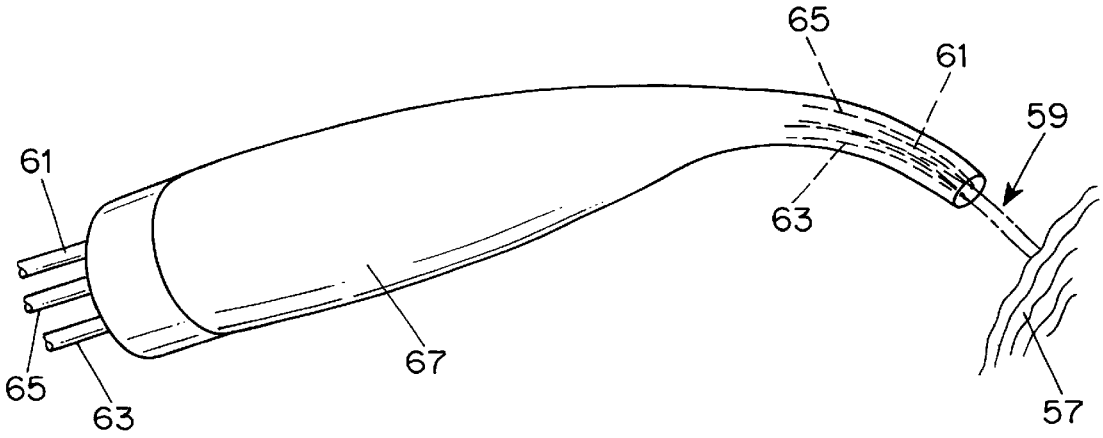
FIG. 3 PRIOR ART
FIG. 3 (corresponding to FIG. 4 in U.S. Pat. No. 5,741, 247) is a prior art laser apparatus which may be used in the method of the invention.

FIG. 3 shows a simple embodiment of a laser apparatus which may be used in the method of this invention. FIG. 3 and its description herein correspond to FIG. 4 in U.S. Pat. No. 5,741,247 and its accompanying description therein. In FIG. 3, a fiberoptic guide 61, an air tube 63, and a water tube 65 are placed within a hand-held housing 67. The water tube 65 is preferably operated under a relatively low pressure, and the air tube 63 is preferably operated under a relatively high pressure. The laser energy from the fiberoptic guide 61 focuses onto a combination of air and water, from the air tube 63 and the water tube 65, at the interaction zone 59. Atomized fluid particles in the air and water mixture absorb energy from the laser energy of the fiberoptic tube 61, and explode. The explosive forces from these atomized fluid particles impart mechanical cutting or etching forces onto the target 57 (which in the present invention is the etchable layer portion of the precursor).

The laser apparatus employed in the present invention typically uses a relatively small amount of water and, further, uses only a small amount of laser energy to expand atomized fluid particles generated from the water. Water is not ordinarily needed to cool the area of etching, since the exploded atomized fluid particles are cooled by exothermic reactions before they contact the target surface (i.e., the etchable layer). Thus, atomized fluid particles or fragments thereof are heated, expanded and cooled before contacting the target surface. The laser apparatus employed in the present invention is thus capable of cutting or etching the etchable layer portion of the precursor without charring, discoloration, or unwanted damage to the etchable layer or underlying layer or substrate.

Figure 4:
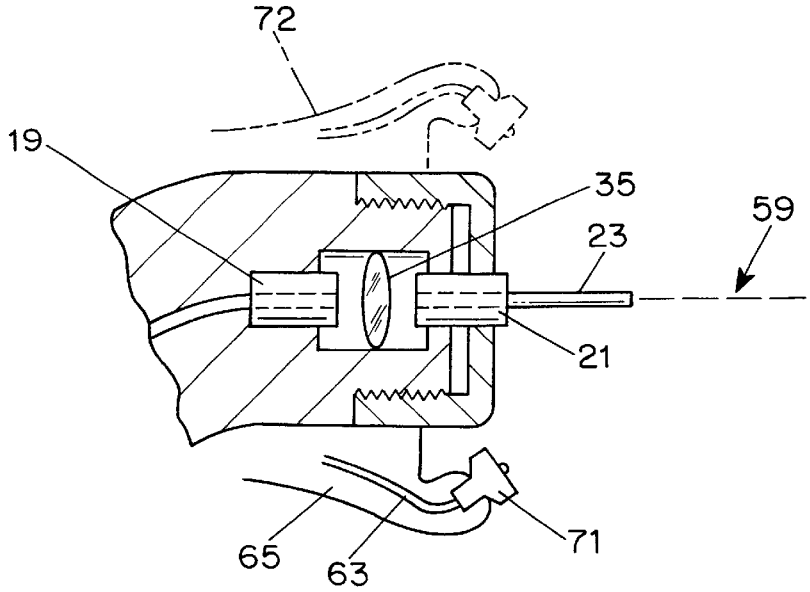
FIG. 4 PRIOR ART
FIG. 4 (corresponding to FIG. 5 in U.S. Pat. No. 5,741, 247) is a prior art laser apparatus which may be used in the method of this invention.

FIG. 4 illustrates a preferred embodiment of a laser apparatus which may be used in the method of this invention. FIG. 4 and its description herein correspond to FIG. 5 in U.S. Pat. No. 5,741,247 and its accompanying description. In FIG. 4, the atomizer for generating atomized fluid particles comprises a nozzle 71, which may be interchanged with other nozzles (not shown) for obtaining various spatial distributions of the atomized fluid particles, according to the type of cut or etch desired. A second nozzle 72, shown in phantom lines, may also be used. The cutting or etching power of the laser apparatus is further controlled by a user control (not shown). In a simple embodiment, the user control controls the air and water pressure entering into the nozzle 71. The nozzle 71 is thus capable of generating many different user-specified combinations of atomized fluid particles and aerosolized sprays. The nozzle 71 is employed to create an engineered combination of small particles of the chosen fluid. The nozzle 71 may comprise several different designs including liquid only, air blast, air assist, swirl, solid cone, etc. When fluid exits the nozzle 71 at a given pressure and rate, it is transformed into particles of user-controllable sizes, velocities, and spatial distributions.

Intense energy is emitted from the fiberoptic guide 23. This intense energy is generated from a laser source. In a particularly preferred embodiment, the laser comprises an erbium, chromium, yttrium, scandium, gallium garnet (Er, Cr:YSGG) solid state laser, which generates light having a wavelength in a range of 2.70 to 2.80 microns. As presently preferred, this laser has a wavelength of approximately 2.78 microns. Although the fluid emitted from the nozzle 71 preferably comprises water, other fluids may be used and appropriate wavelengths of the laser source may be selected to allow for high absorption by the fluid. Other possible laser systems include: an erbium, yttrium, scandium, gallium garnet (Er:YSGG) solid state laser, which generates electromagnetic energy having a wavelength in a range of 2.70 to 2.80 microns; an erbium, yttrium, aluminum garnet (Er:YAG) solid state laser, which generates electromagnetic energy having a wavelength of 2.94 microns; a chromium, thulium, erbium, yttrium, aluminum garnet (CTE:YAG) solid state laser, which generates electromagnetic energy having a wavelength of 2.69 microns: an erbium, yttrium orthoaluminate (Er:$YALO_3$) solid state laser, which generates electromagnetic energy having a wavelength in a range of 2.71 to 2.86 microns; a holmium, yttrium, aluminum garnet (Ho:YAG) solid state laser, which generates electromagnetic energy having a wavelength of 2.10 microns; a quadrupled neodymium, yttrium, aluminum garnet (quadrupled Nd:YAG) solid state laser, which generates electromagnetic energy having a wavelength of 266 nanometers; an argon fluoride (ArF) excimer laser, which generates electromagnetic energy having a wavelength of 193 nanometers; a xenon chloride (XeCl) excimer laser, which generates electromagnetic energy having a wavelength of 308 nanometers; a krypton fluoride (KrF) excimer laser, which generates electromagnetic energy having a wavelength of 248 nanometers; and a carbon dioxide ($CO_2$) laser, which generates electromagnetic energy having a wavelength in a range of 9.0 to 10.6 microns. Water is chosen as the preferred fluid because of its compatibility with the precursor, abundance, and low cost. The actual fluid used may vary as long as it is properly matched with (meaning it is highly absorbed by) the selected laser source wavelength.

As will be well known to those skilled in the art, printing plates such as lithographic plates may be imaged using laser driven exposure devices employing internal drum mounting, external drum mounting and flatbed mounting. For purposes of imaging a lithographic plate, it will be preferable to employ laser pulse cycles or repetition rates that permit timely imaging of the plate surface. If the spot size etched for each laser pulse is of the order of 10 microns in diameter, the pulse or repetition rate required will be of the order of $10^6$ pulses/second using suitable control means to control the laser position with a 10 micron spot size and a $10^8$ pulses/second repetition rate will permit imaging of a plate having an area of 1 $m^2$ in less than 20 minutes. Faster imaging achievable with faster repetition rates, e.g. imaging of such a plate may be accomplished in about 2 minutes using a $10^9$ pulses/second repetition rate.

The delivery system 55 for delivering the laser energy includes a fiberoptic energy guide or equivalent which attaches to the laser system and travels to the desired work site. Fiberoptics or waveguides are typically long, thin and lightweight, and are easily manipulated. Fiberoptics can be made of calcium fluoride (CaF), calcium oxide ($CaO_2$), zironium oxide ($ZrO_2$), zirconium fluoride (ZrF), sapphire, hollow waveguide, liquid core, TeX glass, quartz silica, germanium sulfide, arsenic sulfide, germanium oxide ($GeO_2$), and other materials. Other delivery systems include devices comprising mirrors, lenses and other optical components where the laser energy travels through a cavity, is directed by various mirrors, and is focused onto the interaction zone with specific lenses. The preferred embodiment of laser energy delivery for use in the present invention is through a fiberoptic conductor, because of its light weight and lower cost. However, non-fiberoptic systems may also be used.

The fiberoptic guide 23 can be placed into close proximity of the surface of the etchable layer. This fiberoptic guide 23, however, does not actually contact the surface of the etchable layer. Since the atomized fluid particles from the nozzle 71 are placed into the interaction zone 59, the purpose of the fiberoptic guide 23 is for placing laser energy into this interaction zone, as well. The fiberoptic guide 23 may be made of sapphire. Regardless of the composition of the fiberoptic guide 23, however, the air and water from the nozzle 71 have a cleaning effect on the fiberoptic guide 23. As disclosed in U.S. Pat. No. 5,741,247, it has been found that this cleaning effect is optimal when the nozzle 71 is pointed somewhat directly at the target surface (i.e., the etchable layer portion of the precursor). For example, debris from the mechanical cutting or etching are removed by the spray from the nozzle 71. Additionally, it has been found that this orientation of the nozzle 71, pointed toward the target surface, enhances cutting or etching efficiency. Each atomized fluid particle contains a small amount of initial kinetic energy in the direction of the target surface. When laser energy from the fiberoptic guide 23 contacts an atomized fluid particle, it is believed that the spherical exterior surface of the fluid particle acts as a focusing lens to focus the energy into the fluid particle's interior.

The nozzle 71 is preferably configured to produce atomized sprays with a range of fluid particle sizes narrowly distributed about a mean value. The user input device for controlling cutting or etching efficiency may comprise a simple pressure and flow rate gauge (not shown) or may comprise a control panel or other control means (not shown). Upon a user input for a high resolution etch or cut, relatively small fluid particles are generated by the nozzle 71. Relatively large fluid particles are generated for a user input specifying a low resolution etch or cut. A user input specifying a deep penetration etch or cut causes the nozzle 71 to generate a relatively low density distribution of fluid particles, and a user input specifying a shallow penetration etch or cut causes the nozzle 71 to generate a relatively high density distribution of fluid particles. If the user input device comprises a simple pressure and flow rate gauge, then a relatively low density distribution or relatively small fluid particles can be generated in response to a user input specifying a high etching or cutting efficiency. Similarly, a relatively high density distribution of relatively large fluid particles can be generated in response to a user input specifying a low etching or cutting efficiency. Other variations are also possible including computer control of pressure and flow rate which is coordinated with computer-to-plate (CTP) control of the imagewise etching.

These various parameters can be adjusted according to the type of etch or cut and the type of etchable layer employed in the precursor. A user may also adjust the combination of atomized fluid particles exiting the nozzle 71 to efficiently implement cooling and cleaning of the fiberoptics 23. According to a preferred embodiment, the combination of atomized fluid particles may comprise a distribution, velocity and mean diameter to effectively cool the fiberoptic guide 23, while simultaneously keeping the fiberoptic guide 23 clean of debris such as debris material from the etched areas which may be introduced thereon while practicing the method of this invention. The diameters of the atomized fluid particles can be less than, almost equal to, or greater than the wavelength of the incident laser energy.

According to the present invention, the etchable layer portion of the precursor is cut or etched by mechanical forces which imagewise impart kinetic energy to the etchable layer, instead of by conventional thermal cutting forces. Laser energy is used only to imagewise induce mechanical forces (i.e. kinetic energy) onto the etchable layer. Thus, the atomized fluid particles act as the medium for transforming the electromagnetic energy of the laser into the mechanical forces or kinetic energy required to achieve the imagewise mechanical cutting or etching effect of the present invention. The laser energy itself is not directly absorbed by the etchable layer. The mechanical interaction of the present invention eliminates the undesirable thermal side-effects typically associated with conventional laser cutting or etching systems.

Figure 5:
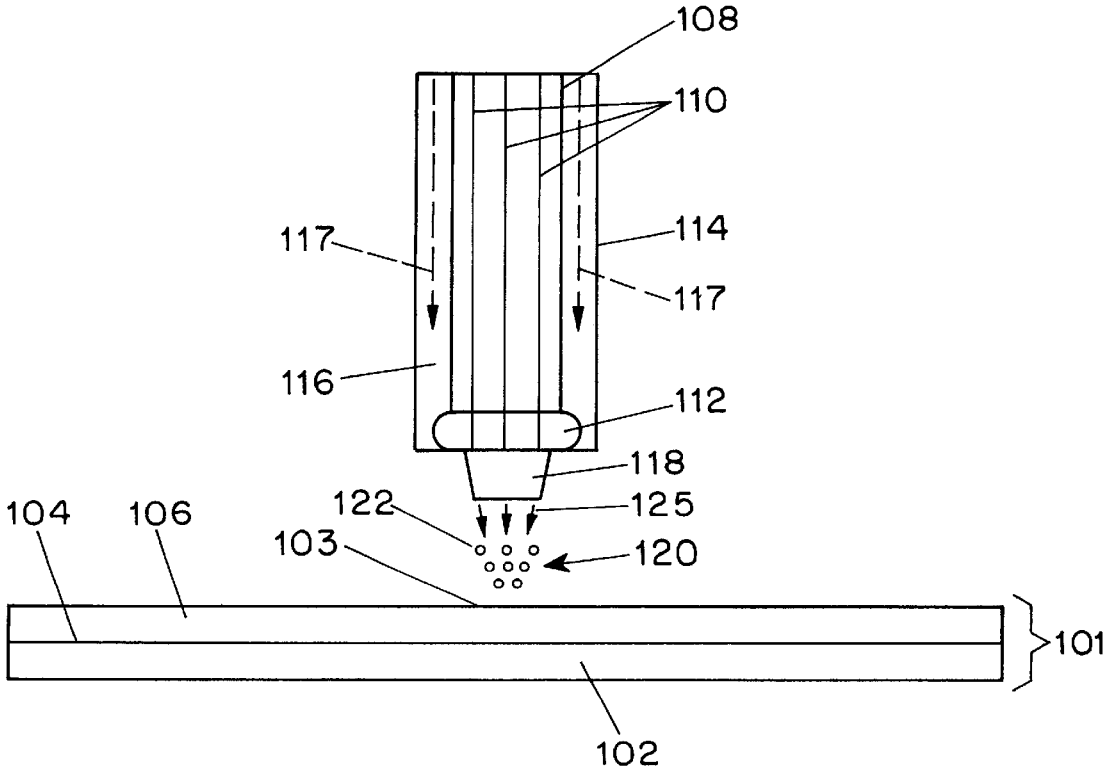
FIG. 5 depicts the overall process configuration of a preferred embodiment of an apparatus which may be used in the method of this invention.

FIG. 5 depicts the overall process configuration for a preferred embodiment of the method of this invention. In FIG. 5, a lithographic printing plate is prepared by first providing an imageable printing plate precursor 101 which comprises a substrate 102 having a hydrophilic surface 104 and an etchable material which in this embodiment is an ink-receptive polymeric layer 106 applied to the hydrophilic substrate surface 104. This invention also includes embodiments wherein the affinities of the substrate and one or more layers are "switched"; i.e. a hydrophilic layer may be applied to a hydrophobic substrate surface, or a hydrophobic layer may be applied to a hydrophilic substrate surface. Also provided is a source of laser energy which in FIG. 5 is depicted as a first housing 108 containing a plurality of fiber optic leads 110 capable of conveying laser energy (a singular fiber optic lead may alternatively be used). The laser energy may optionally be focused by focusing optics 112, which is depicted as a single lens but which may be one or more lenses and associated optical devices. The focusing optics preferably focus the laser energy in a diameter of about 5–500 $\mu$m. A second annular housing 114 is concentric with and contains first housing 108. The annular regions 116 permit liquid to travel therethrough (as shown by liquid flow lines 117) and thereafter to be atomized and guided by a guide 118 to an interaction zone 120 in proximity to the surface 103 of the ink-receptive polymer layer 106, as shown by representative liquid atomized droplets 122. The laser energy (indicated by path lines 125) is directed at and impinges the droplets in the interaction zone 120 located above the surface of the ink-receptive polymer layer 106 as shown by representative laser path lines 125. By controlling the power and wavelength of the laser or the size and energy absorbing capability of the atomized liquid droplets, or combinations thereof, as will be well understood by those skilled in the art, the impinging of the laser energy upon the liquid droplets in proximity to the surface of the ink-receptive polymer layer 106 causes the liquid droplets absorbing the laser energy to rapidly vaporize. A dye such as an IR absorbing dye may be included in the liquid droplets to enhance liquid droplet absorption of the laser energy.

Rapid vaporization of the atomized droplets by absorption of laser energy in turn causes the increase of kinetic energy which is selectively transferred to the surface of the ink-receptive polymer layer 106, and the ink receptive layer is thereby imagewise etched or cut by the kinetic energy transferred. Any residual or waste material derived from the cutting or etching of the ink-receptive polymeric layer may be removed by washing, blowing, wiping or other techniques well known to those skilled in the art.

Figure 6:
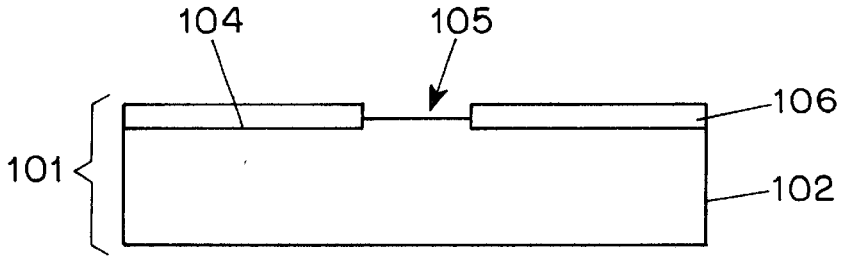
FIG. 6 depicts a simplified cross-sectional view of a printing plate of this invention prepared using the apparatus of FIG. 5.

FIG. 6 is a simplified cross-sectional view of the precursor 101 of FIG. 5 after application of the embodiment of the method of this invention as described above with respect to FIG. 5. As shown in FIG. 6, the desired portion of the ink-receptive polymeric layer 106 has been imagewise etched or cut, thereby removing the desired portion of the ink-receptive polymeric layer 106 and exposing a region 105 of the hydrophilic surface 104 of the substrate 102.

Figure 7:
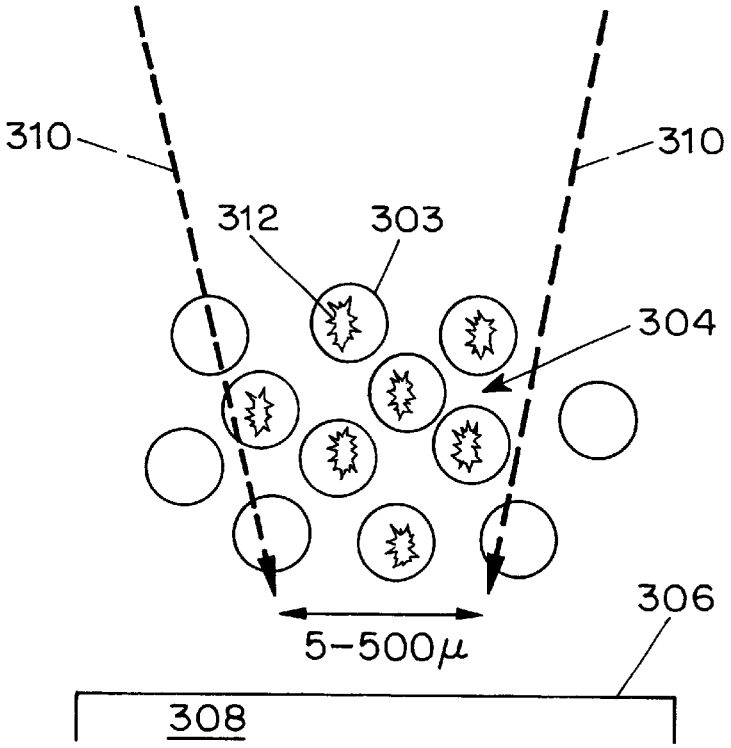
FIG. 7 depicts a simplified view of the "interaction zone" and atomized droplets contained therein.

FIG. 7 depicts a simplified view of the "interaction zone" which the atomized droplets are impinged by and absorb the laser energy. In FIG. 7, liquid droplets have been introduced into interaction zone 304 located above the upper surface 306 of etchable layer 308. Laser energy (indicated by dashed lines 310) has also been introduced into interaction zone 304, and laser energy 310 has impinged upon and been absorbed by a number of droplets 303, as indicated by areas 312 on droplets 303. As indicated in FIG. 7, the interaction zone preferably has a diameter of about 5–500 $\mu$m.

Figure 8:
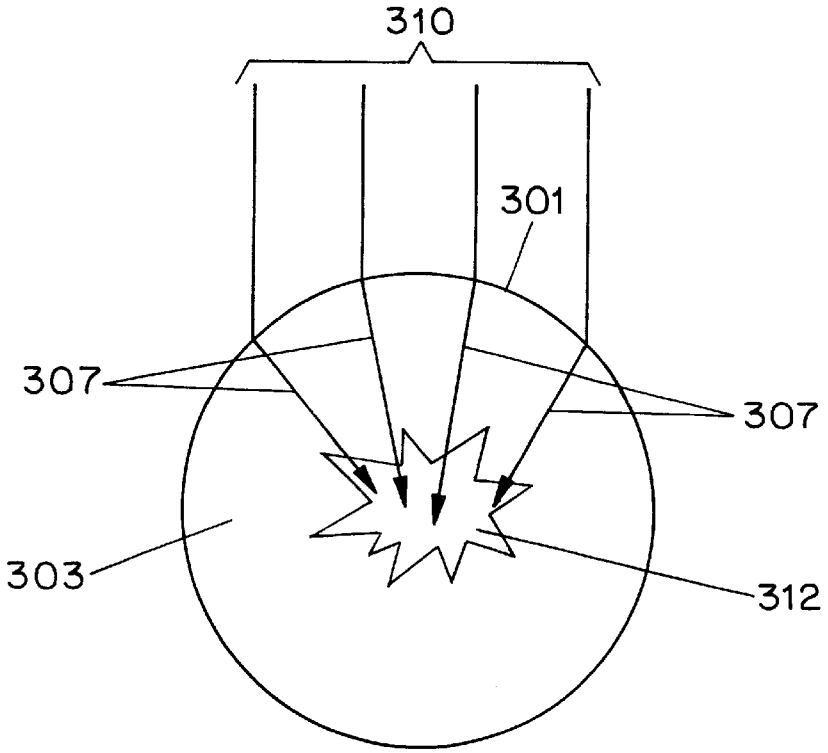
FIG. 8 depicts a simplified view of a single atomized droplet in the "interaction zone."

FIG. 8 depicts a simplified view of a single droplet 303 which has absorbed laser radiation in the interaction zone as previously described with respect to FIG. 7. Without wishing to be bound by any one theory, it is believed that laser radiation (depicted by rays 310) is absorbed at the surface 301 of droplet 303, and is thereafter focused and concentrated in the central region 312 of droplet 303 (as depicted by rays 307) which causes formation of a concentrated, high energy density area, which in turn causes rapid vaporization of liquid droplet 303. The near-instantaneous liquid-to-gas phase change of droplet 303 transfers large amounts of kinetic energy to remaining droplet fragments (not shown) and the generation of a pressure wave. When the rapidly moving droplet fragments and pressure wave collide with the upper surface of the etchable layer to be imaged (not shown), kinetic energy is imparted into the etchable layer, thereby causing the etchable layer to initially fragment and to ultimately be imagewise etched or cut.

In the method and printing plate of this invention, the printing plate precursor employed comprises a topmost first etchable layer and a second layer located below the first layer, wherein the second layer and the first layer have different affinities for at least one printing liquid. More particularly, the second layer and the topmost etchable first layer have different affinities for a printing ink (in a dry-plate construction) or an ink and an abhesive fluid for ink (in a wet-plate construction). The atomized fluid particles imagewise impart kinetic energy to the topmost etchable first layer, thereby imagewise etching the etchable layer and resulting in an image spot whose affinity for the printing liquid (e.g. ink or ink-abhesive fluid) differs from that of the unexposed first layer. For example, in a wet plate construction the topmost etchable first layer may be hydrophilic and the underlying second layer may be hydrophobic, or vice versa. In a dry plate construction, the topmost etchable first layer may be oleophilic and the second layer may be oleophobic, or vice versa. It should be noted, for example, that in waterless printing an aluminum or polyester substrate can serve as the oleophilic surface as compared to an oleophobic silicone top layer. Similarly, in wet printing, an aluminum or polyester substrate may serve as the relatively hydrophilic surface as compared to the hydrophobic/oleophilic top layer.

In a preferred embodiment of this invention, the second layer of the precursor comprises a substrate. The substrate is preferably selected from the group consisting of metal, polyester and paper. The metal substrate may also be treated by electrograining and other techniques well known to those skilled in the art. In a particularly preferred embodiment, the substrate is an aluminum substrate, and may have a hydrophilic surface or a sodium silicate surface.

The second layer may comprise such a substrate and one or more layers applied to the substrate. For example, the second layer may comprise an aluminum substrate having an oleophilic layer applied to the substrate surface, an aluminum substrate having a silicone polymer material applied to the substrate, or a polyester substrate having a silicone polymer material or a photopolymer resin applied to the substrate.

It will be apparent to those skilled in the art from the description and examples described herein that this invention is applicable to a number of embodiments which comprise combinations of a printing plate substrate and one or more surfaces or layers applied to the substrate. Without wishing to be bound in any way, representative embodiments of precursors which may be employed in this invention are as follows:

An aluminum substrate having a hydrophilic surface.

An aluminum substrate having a hydrophilic surface and a hydrophobic layer applied to the hydrophilic surface.

An aluminum substrate having a hydrophilic surface, and a silicone layer applied to the hydrophilic surface.

An aluminum substrate having a hydrophilic surface, a hydrophilic layer applied to the hydrophilic surface, and a hydrophobic layer applied to the hydrophilic layer.

An aluminum substrate having a silicone layer applied thereto.

An aluminum substrate having a hydrophilic surface, a hydrophobic layer applied to the hydrophilic surface, and a silicone layer applied to the hydrophobic layer.

A polyester substrate having a hydrophilic surface.

A polyester substrate having a hydrophilic surface and a hydrophobic layer applied to the hydrophilic surface.

A polyester substrate having a silicone layer applied thereto.

A polyester substrate having a hydrophilic surface, and a silicone layer applied to the hydrophilic surface.

A flexographic substrate having a hydrophobic layer applied thereto.

A flexographic substrate having a hydrophilic layer applied thereto.

The following examples illustrate various preferred embodiments of this invention. It will be understood that the following examples are merely illustrative and are not meant to limit the invention in any way. The laser employed for etching in Examples 1–6 was a MILLENNIUM® Er,Cr:YSGG dental laser having a power of 0.0–6.0 W and a pulse energy of 0–300 mJ used in conjunction with MVP-HS laser handpiece, both available from BIOLASE Technology, Inc. (San Clemente, Calif.).

EXAMPLE 1

Direct-to-Plate, Processless Positive-Working Plate

Figure 9:
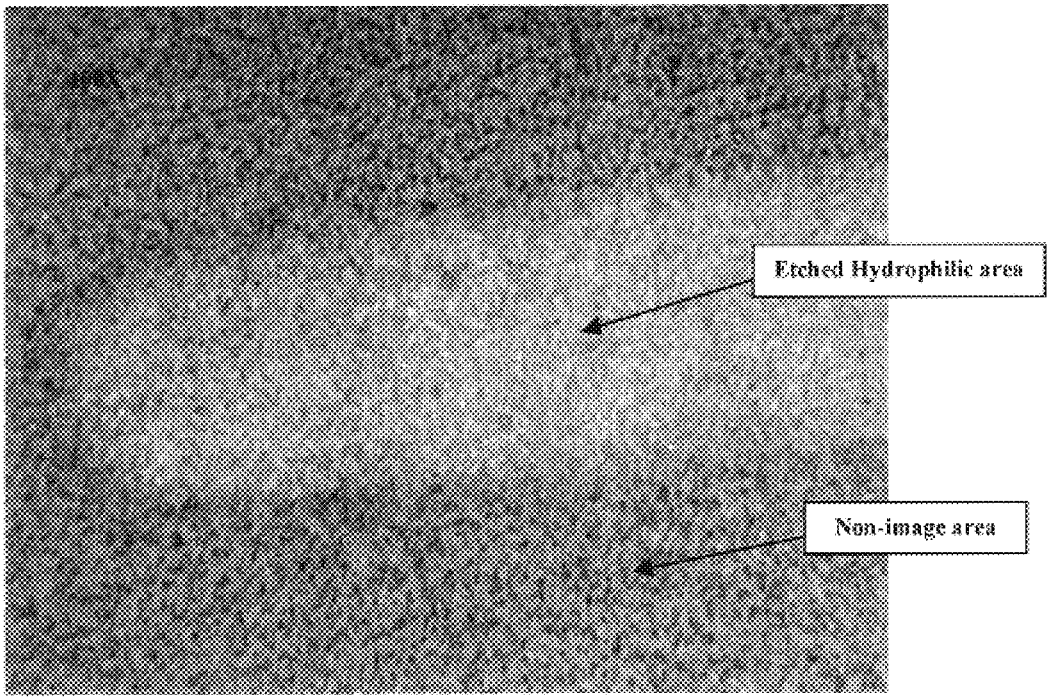
FIG. 9 is a photograph of the etched plate described in Example 1.

A sample of a conventional negative-working printing plate precursor material (VISTAR 360, available from Kodak Polychrome Graphics LLC) was employed in this example. The sample was an aluminum substrate having a hydrophilic surface, and an oleophilic polymeric material applied to the substrate hydrophilic surface. The sample was etched by hand by etching a line into the oleophilic polymeric material using the laser at 300 μj/pulse of power and 20 hz repetition rate. The oleophilic polymeric material in the etched area was removed, thereby exposing the underlying hydrophilic substrate surface, whereas the non-etched portions remained oleophilic (i.e. ink-receptive). A photograph of the etched and non-etched areas is shown in FIG. 9.

EXAMPLE 2

Direct-to-Plate, Processless Positive-Working Plate

Figure 10:
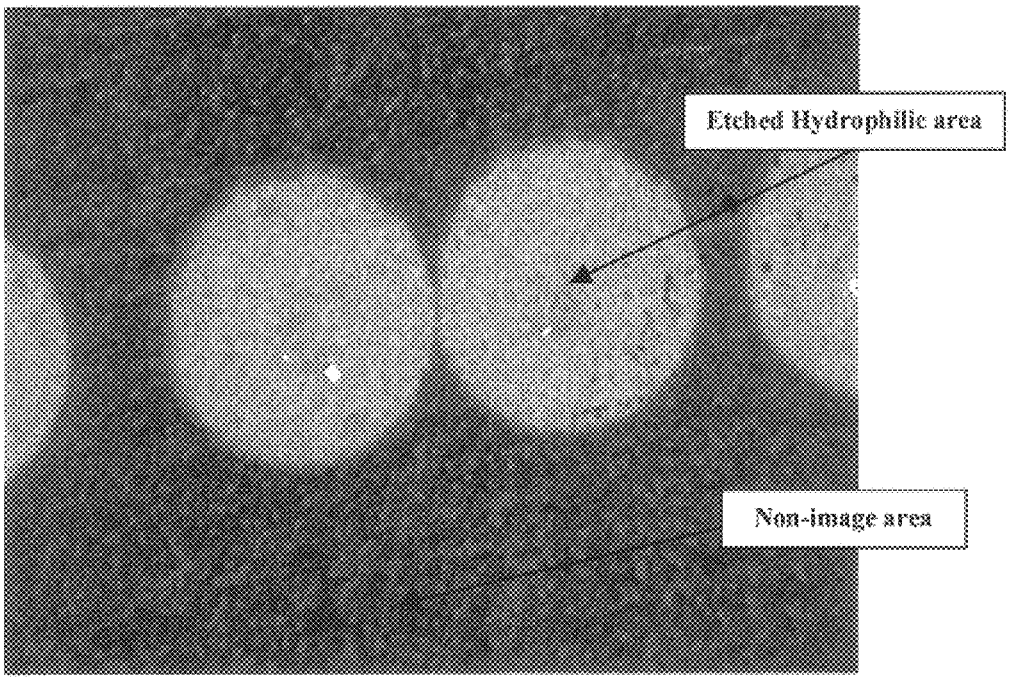
FIG. 10 is a photograph of the etched plate described in Example 2.

A sample of a conventional positive-working printing plate precursor material (ELECTRA, available from Kodak Polychrome Graphics LLC) was employed in this example. The sample was an aluminum substrate having a hydrophilic surface, and an oleophilic polymeric material applied to the substrate hydrophilic surface. The sample was etched by hand by etching a line via pulsed outputs into the oleophilic polymeric material using the laser at 300 mj/pulse of power and 20 hz repetition rate. The oleophilic polymeric material in the etched area was ablated, thereby exposing the underlying hydrophilic substrate surface, whereas the non-etched portions remained oleophilic (i.e. ink-receptive). A photograph of the etched and non-etched areas is shown in FIG. 10.

EXAMPLE 3

Waterless Dual Function Plate

Figure 11:
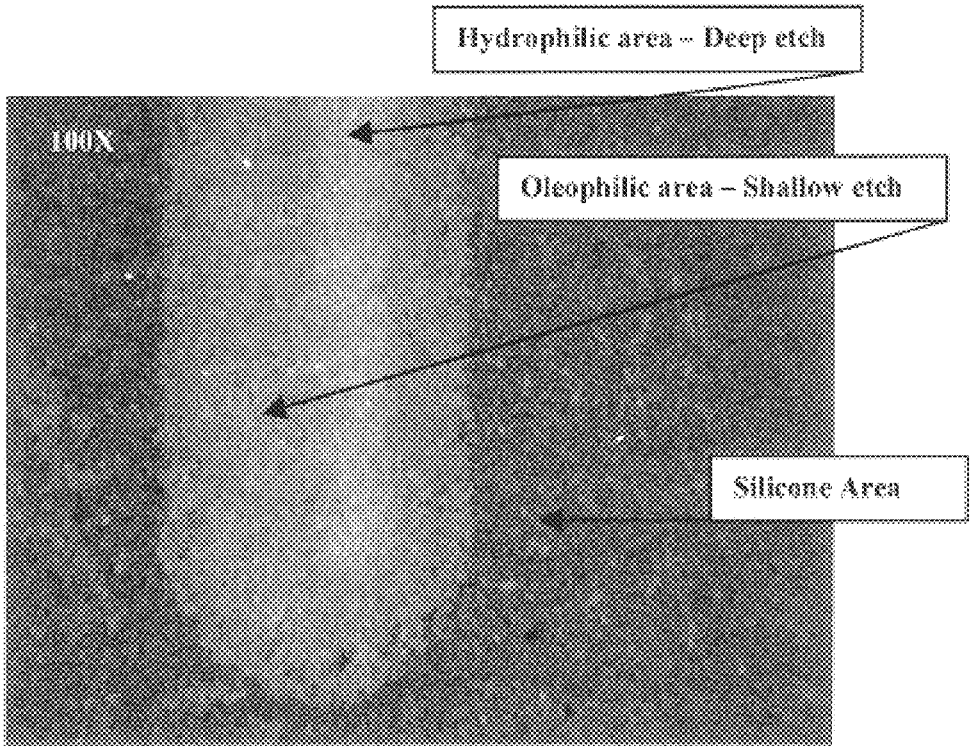
FIG. 11 is a photograph of the etched plate described in Example 3.

A sample of a conventional negative-working printing plate precursor material (NAW, available from Kodak Polychrome Graphics LLC) was employed in this example. The sample was an aluminum substrate having a hydrophilic surface, an intermediate layer of oleophilic polymeric material applied to the substrate hydrophilic surface, and an outer layer of silicone polymer. The sample was etched by hand by etching a line into only the silicone polymer layer using the laser at 300 mj/pulse of power and 20 hz repetion rate, but at a lower focus of power compared to Examples 1 and 2. The silicone polymer material in the etched area was removed, thereby exposing the underlying oleophilic polymer material, which is ink-receptive. Such an application represents a standard negative-working printing plate, in which the imaged area is oleophilic. The sample was also etched by hand by etching a line into both the silicone polymer layer and underlying oleophilic polymer layer using the laser at 300 mj/pulse of power and 20 hz repetition rate. Both the silicone polymer material and oleophilic polymeric material in the etched area were removed, thereby exposing the underlying hydrophilic surface of the aluminum substrate. Photographs of the etched and non-etched areas for both applications are shown in FIG. 11. This example demonstrated a waterless plate which may be employed with both water based and solvent based inks.

EXAMPLE 4

Waterless, Direct-to-Plate, Single Layer Silicone Polyester Plate

Figure 12:
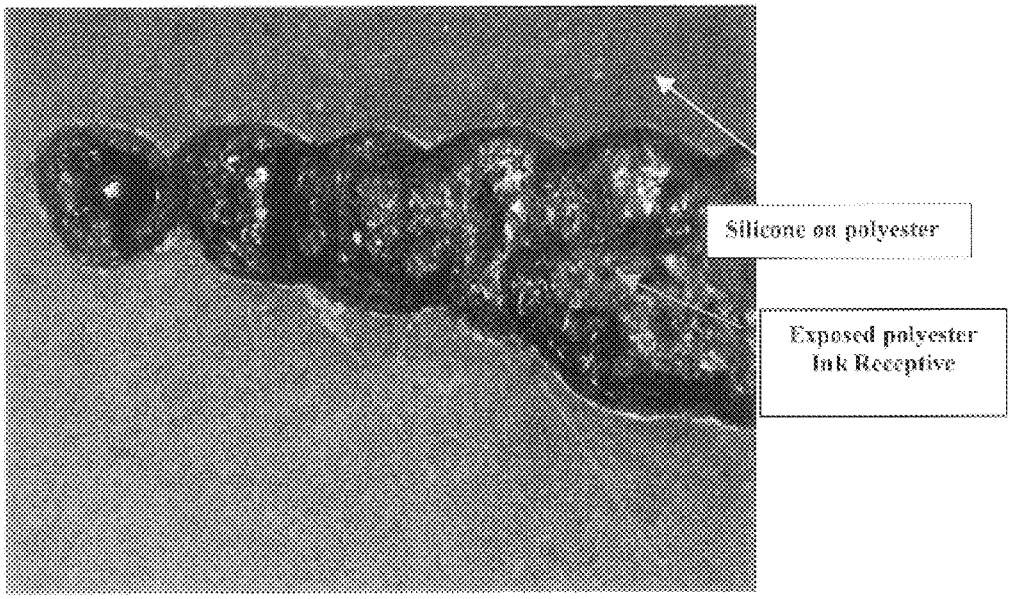
FIG. 12 is a photograph of the etched plate described in Example 4.

A sample of a 7 mil subbed polyester base was employed in this example. The polyester base sample was hydrophobic and oleophilic, and was coated with a silicone polymer which was both hydrophobic and oleophobic. The sample was etched by hand by etching a line into the silicone polymer outer layer using the laser at 300 mj/pulse of power and a 20 hz repetition rate. Only the silicone material in the etched area was removed, thereby exposing the underlying hydrophobic and oleophilic polyester substrate surface, whereas the non-etched portions remained both hydrophobic and oleophobic. Such an application represents a standard negative-working printing plate, in which the imaged area is oleophilic (i.e. ink-receptive), whereas the non-imaged area is both hydrophobic and oleophobic. A photograph of the etched and non-etched areas is shown in FIG. 12. This example demonstrated a waterless plate which may be employed with both water based and solvent based inks.

EXAMPLE 5

Figure 13:
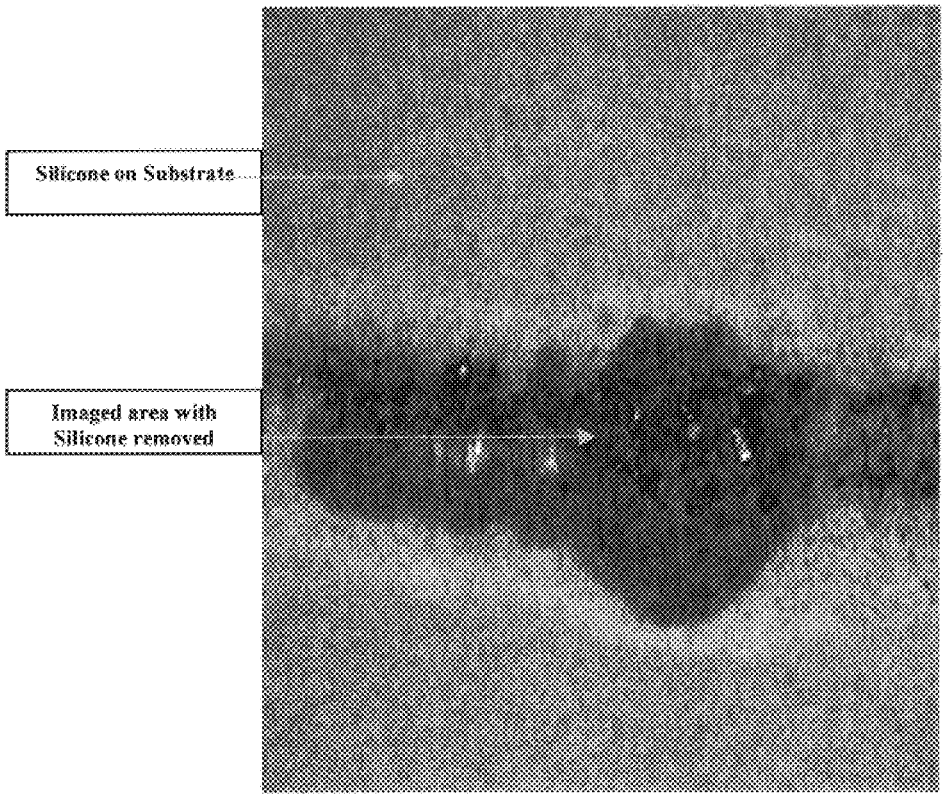
FIG. 13 is a photograph of the etched plate described in Example 5.

Waterless, Processless, Direct-to-Plate, Single Layer Silicone Aluminum Plate A sample of a conventional electrolytically grained aluminum substrate material was employed in this example. The substrate sample surface was first degreased, chemically etched and subjected to a desmut step (removal of reaction products of the aluminum and etchant). The substrate was then electrolytically grained (EG) using an AC current of 30–60 A/cm$^2$ in a hydrochloric acid solution (10 g/liter) for 30 seconds at 25 degrees C., followed by a post-etching alkaline wash and a desmut step. The grained plate is then anodized using DC current of about 8 A/cm$^2$ for 30 seconds in a sulfuric acid solution (280 g/liter) at 30 degrees C. The anodized substrate was thereafter immersed in a sodium silicate solution, thereby coating the substrate with a sodium silicate interlayer which is hydrophilic. The coated plate was then rinsed with deionized water and dried at room temperature. The sodium silicate interlayer was then coated with a silicone polymer surface which was both oleophobic and hydrophobic. The sample was etched by hand by etching a line into the silicone polymer outerlayer material using the laser at 300 mj/pulse of power and a 20 hz repetition rate. The silicone outerlayer material in the etched area was removed, thereby exposing the underlying hydrophilic sodium silicate interlayer, whereas the non-etched portions of the silicone layer remained both hydrophobic and oleophobic. A photograph of the etched and non-etched areas is shown in FIG. 13. This example demonstrated a waterless plate which may be employed with both water based and solvent based inks. In other embodiments, a raw aluminum plate coated with a silicone coating may be employed, or a PVPA-treated plated coated with a silicone coating may be employed. Etching of the imaged area renders the imaged area more oleophilic or hydrophilic (depending upon the substrate used) than in a standard platemaking process, while leaving the non-imaged areas both hydrophobic and oleophobic. This embodiment demonstrates that a single plate having a single coated layer applied to a substrate may be used to prepare waterless plates for both water-based and solvent-based ink systems.

EXAMPLE 6

Waterless, Processless, Direct-to-Plate, Single Layer Flexographic Plate

A flexographic plate precursor blank sample was prepared by spreading and exposing a liquid photopolymer resin (MACDERMID photopolymer resin available from E. I. Dupont de Nemours Inc.) on a dimensionally stable polyester base according to standard practice for liquid flexography, as is well known to those skilled in the art. The sample was etched by hand by etching a line into the photopolymer resin outer layer using the laser at 300 mj/pulse of power and a 20 hz repetition rate. Only the photopolymer resin material in the etched area was etched, thereby forming the relief image and setting the floor depth, whereas the non-etched portions remained oleophilic. This example demonstrated an embodiment of the invention in which a printing plate may be prepared by rapidly etching and thus removing unwanted background. Such an embodiment advantageously enables a plate to be prepared in which the floor depth and the tower height of the image area may be controlled. This is additionally advantageous in situations where the halftone tower height may be less than the solid image height, thereby alleviating compression issues on press. As depicted in FIGS. 14A, 14C, and 14D, the laser etched a deep groove in the photopolymer outer layer (FIG. 14A also compares the groove size to a paper clip). FIG. 14B depicts rapid surface etching of the photopolymer outer layer that was achieved in accordance with this embodiment of the invention.

Although this invention has been illustrated by reference to specific embodiments, it will be apparent to those skilled in the art that various changes and modifications may be made which clearly fall within the scope of this invention.

The invention claimed is:

1. A method of producing a printing plate comprising:

(a) providing a printing plate precursor comprising a topmost etchable first layer and a second layer located below the first layer, wherein the first and second layers have different affinities for at least one printing liquid;

(b) providing atomized fluid particles in an interaction zone located above the surface of the first layer; and (c) imagewise directing laser energy into the interaction zone, wherein the laser energy has a wavelength which is substantially absorbed by the atomized fluid particles in the interaction zone, and the absorption of the laser energy causes the atomized fluid particles to imagewise impart kinetic energy to and etch the first layer.

2. The method of claim 1, wherein the second layer comprises a substrate selected from the group consisting of metal, polyester and paper.

3. The method of claim 2, wherein the substrate is an aluminum substrate having a hydrophilic surface.

4. The method of claim 1, wherein the second layer comprises an aluminum substrate having a hydrophilic surface, and the first layer comprises an oleophilic polymeric material applied to the hydrophilic substrate surface.

5. The method of claim 1, wherein the second layer comprises an aluminum substrate and the first layer comprises a silicone polymer material.

6. The method of claim 5, wherein the second layer further comprises an intermediate layer comprising an oleophilic polymeric material which resides upon the aluminum substrate.

7. The method of claim 1, wherein the second layer comprises a polyester substrate and the first layer comprises a silicone polymer material.

8. The method of claim 1, wherein the second layer comprises an electrograined aluminum substrate having a sodium silicate surface and the first layer comprises a silicone polymer material.

9. The method of claim 1, wherein the second layer comprises a hydrophilized polyester substrate and the first layer comprises a photopolymer resin.

10. The method of claim 1, wherein the laser energy is obtained from an erbium, chromium, yttrium, scandium, gallium garnet laser.

* * * * *